US012529179B2

(12) United States Patent
Lee et al.

(10) Patent No.: US 12,529,179 B2
(45) Date of Patent: Jan. 20, 2026

(54) CLOTHING TREATMENT APPARATUS

(71) Applicant: LG ELECTRONICS INC., Seoul (KR)

(72) Inventors: Jihong Lee, Seoul (KR); Minkyu Sang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 476 days.

(21) Appl. No.: 17/920,674

(22) PCT Filed: Apr. 23, 2021

(86) PCT No.: PCT/KR2021/005177
§ 371 (c)(1),
(2) Date: Oct. 21, 2022

(87) PCT Pub. No.: WO2021/215877
PCT Pub. Date: Oct. 28, 2021

(65) Prior Publication Data

US 2023/0151529 A1 May 18, 2023

(30) Foreign Application Priority Data

Apr. 23, 2020 (KR) ..... 10-2020-0049203

(51) Int. Cl.
*D06F 37/24* (2006.01)
*D06F 37/12* (2006.01)

(52) U.S. Cl.
CPC ..... *D06F 37/245* (2013.01); *D06F 37/12* (2013.01)

(58) Field of Classification Search
CPC ..... D06F 37/245; D06F 37/12
See application file for complete search history.

(56) References Cited

U.S. PATENT DOCUMENTS 4,044,626 A 8/1977 Hayashi et al.
4,502,303 A * 3/1985 Wasemann ..... D06F 37/12 68/23.2

(Continued)

FOREIGN PATENT DOCUMENTS

CN 209456740 U 10/2019
JP 10-57671 A 3/1998

(Continued)

OTHER PUBLICATIONS

Machine translation of KR 10-2011-0012362 A to Yoon et al. (Year: 2011).*

*Primary Examiner* — Joseph L. Perrin
(74) *Attorney, Agent, or Firm* — Birch, Stewart, Kolasch & Birch, LLP

(57) ABSTRACT

A clothing treatment apparatus includes a tub; a drum extending in a cylindrical shape, capable of being opened upward, and rotatably disposed in the tub; a balancer fixed to an upper portion the drum, extending along a circumference of the drum, and providing a channel communicating with an inner space of the drum; and a chamber formed inside the balancer and extending along the balancer. The chamber includes a first chamber forming a lower portion of the chamber, and a second chamber forming an upper portion of the chamber. A width of the first chamber is greater than a width of the second chamber.

9 Claims, 9 Drawing Sheets

(56) References Cited

U.S. PATENT DOCUMENTS

| | | | | | |
|---|---|---|---|---|---|
| 4,646,545 | A * | 3/1987 | Fanson | D06F 37/12 | 68/23.2 |
| 4,656,847 | A * | 4/1987 | Bean | D06F 37/12 | 68/23.2 |
| 5,765,404 | A * | 6/1998 | Fanson | D06F 37/24 | 74/572.4 |
| 6,550,292 | B1 * | 4/2003 | Southworth | D06F 37/245 | 74/572.4 |
| 7,866,191 | B2 | 1/2011 | Turner et al. | | |
| 8,276,406 | B2 * | 10/2012 | Soto | D06F 37/245 | 68/23.2 |
| 9,453,297 | B2 * | 9/2016 | Alexander | D06F 37/245 | |
| 2011/0247373 | A1 * | 10/2011 | Sharp | D06F 37/245 | 68/131 |
| 2016/0160421 | A1 * | 6/2016 | Alexander | D06F 37/245 | 74/572.4 |
| 2016/0258103 | A1 * | 9/2016 | Hunnell | D06F 37/267 | |
| 2018/0237972 | A1 * | 8/2018 | Lv | D06F 37/24 | |
| 2019/0010655 | A1 * | 1/2019 | Lee | D06F 37/40 | |
| 2019/0203397 | A1 * | 7/2019 | Ryu | D06F 37/12 | |
| 2020/0102683 | A1 * | 4/2020 | Jang | D06F 37/245 | |

FOREIGN PATENT DOCUMENTS

| | | | |
|---|---|---|---|
| KR | 20-0182535 | Y1 | 5/2000 |
| KR | 10-0784404 | B1 | 12/2007 |
| KR | 10-2011-0012362 | A | 2/2011 |
| KR | 10-2015-0137652 | A | 12/2015 |

* cited by examiner

CLOTHING TREATMENT APPARATUS

CROSS REFERENCE TO RELATED APPLICATIONS

This application is the National Phase of PCT International Application No. PCT/KR2021/005177, filed on Apr. 23, 2021, which claims priority under 35 U.S.C. 119 (a) to Patent Application No. 10-2020-0049203, filed in the Republic of Korea on Apr. 23, 2020, all of which are hereby expressly incorporated by reference into the present application.

BACKGROUND

Field of the Invention

The present disclosure relates to a clothing treatment apparatus.

Related Art

In general, a clothing treatment apparatus is a concept including an apparatus for washing clothing (an object to wash, an object to dry), an apparatus for drying clothing, and an apparatus for performing both washing and drying of clothing.

Recently, in order to wash and/or dry a large amount of objects at a time, the capacity of a tub and a drum is increasing in a clothing treatment apparatus.

If a small amount of object is processed using general clothing treatment apparatus, water and power consumption may be wasted.

Accordingly, a clothing treatment apparatus having smaller size and capacity than those of a general clothing treatment apparatus has been developed.

Such a relatively small-sized clothing treatment apparatus may be designed to have an equal or similar width and a smaller height compared to the general clothing treatment apparatus, and may be positioned on or underneath the general clothing treatment apparatus.

The relatively small-sized clothing treatment apparatus has a limitation in height of a cabinet for convenience of use and a limitation in width similarly to the general clothing treatment apparatus.

Due to the limitations in the size of the cabinet, when the capacity of the tub and the drum is too small, a small-sized clothing treatment apparatus may be significantly less effective.

SUMMARY

The present disclosure aims to solve the above and other problems.

Another aspect of the present disclosure provides a clothing treatment apparatus capable of maximizing the volume of the drum.

Another aspect of the present disclosure provides a clothing treatment apparatus capable of maximizing the volume of the tub.

Another aspect of the present disclosure provides a clothing treatment apparatus capable of maximizing the volume of a tub and a drum positioned inside a cabinet and/or drawer whose width is set to be greater than a height.

Another aspect of the present disclosure provides a clothing treatment apparatus capable of easily controlling vibration of a tub and a drum.

Another aspect of the present disclosure provides a clothing treatment apparatus capable of minimizing a risk of damage to a drain pipe and a heating part provided at a bottom surface of a tub while maximizing the volume of the tub.

According to an aspect of the present disclosure, there is provided a clothing treatment apparatus including: a tub; a drum rotatably disposed in the tub; a balancer; and a chamber formed inside the balancer.

The tub may extend in a cylindrical shape. The tub may extend in a cylindrical shape having a diameter greater than a length.

The tub may include a tub body extending in a cylindrical shape. The tub body may extend in a cylindrical shape having a diameter greater than a length. The tub body may be opened upward.

The tub may include a cover forming an upper surface of the tub, and an extension extending downward from an edge of the cover. The extension may be coupled to an upper portion of the tub body.

The drum may extend in a cylindrical shape. The drum may be opened upward. The drum may have a diameter greater than a length (height) thereof.

The balancer may be fixed to an upper portion of the drum. The balancer may extend along a circumference of the drum. The balancer may have a ring shape. The balancer may provide a channel communicating with an inner space of the drum.

The balancer may reduce eccentricity of the drum. The balancer may reduce vibration of the tub due to rotation of the drum.

A liquid may be accommodated in the chamber. Alternatively, a solid may be accommodated in the chamber.

The chamber may include a first chamber forming a lower portion of the chamber and a second chamber forming an upper portion of the chamber.

A width of the first chamber may be greater than a width of the second chamber.

A width of the first chamber and a width of the second chamber may be defined in a radial direction of the drum.

The balancer may extend upward past an upper end of the drum. A lower end of the balancer may be positioned below an upper end of the drum. An upper end of the balancer may be positioned above the upper end of the drum.

A lower end of the first chamber may be positioned below the upper end of the drum. An upper end of the second chamber may be positioned above the upper end of the drum.

The drum may include a rim protruding from an upper end of a circumferential surface of the drum toward a center of rotation of the drum. The rim may extend along the circumference of the drum. The rim may extend in a circumferential direction of the drum. The rim may provide an opening for the drum.

The drum may include a support part protruding from an inner circumferential surface of the drum. The support part may extend along the circumference of the drum. The support part may extend in the circumferential direction of the drum. The support part may be spaced downward from the rim.

The balancer may include a fixing part inserted between the rim and the support part of the drum. The fixing part may protrude from an outer surface of the balancer facing the inner circumferential surface of the drum.

The balancer may further include a fastening groove into which the support part of the drum is to be inserted. The fastening groove may be recessed at a lower end of the fixing part.

The chamber may be provided with a bottom surface. The bottom surface of the chamber may be positioned below an upper end of the fastening groove.

The balancer may include a first housing forming a lower exterior of the balancer. The first housing may provide the first chamber. The first chamber may be formed inside the first housing.

The balancer may include a second housing forming an upper exterior of the balancer. The second housing may provide the second chamber. The second chamber may be formed inside the second housing.

An upper end of the first housing and a lower end of the second housing may be connected to each other. The first chamber and the second chamber may be connected.

The first housing and the second housing may be coupled by thermal fusion.

In a radial direction of the drum, a thickness of the second housing may be greater than a thickness of the first housing.

An outer surface of the second housing facing the circumferential surface of the tub may be positioned on an outer side than an outer surface of the first housing. The outer surface of the first housing may be positioned on an inner side in the radial direction of the drum than the outer circumferential surface of the drum.

The first and second housings may each include an inner wall providing the channel, and an outer wall spaced apart outward from the inner wall. The chamber may be positioned between inner and outer walls of the first and second housings.

A thickness of the inner wall of the first housing may be smaller than a thickness of the inner wall of the second housing. A thickness of the outer wall of the first housing may be smaller than a thickness of the outer wall of the second housing.

The inner walls of the first and second housings may include an outer surface facing the center of rotation of the drum, and an inner surface facing the chamber. The outer walls of the first and second housings may include an outer surface facing a circumferential surface of the tub, and an inner surface facing the chamber.

The outer surface of the inner wall of the first housing and the outer surface of the inner wall of the second housing may be aligned with each other, or the outer surface of the inner wall of the second housing may be closer to the center of rotation of the drum than the outer surface of the inner wall of the first housing.

The inner surface of the inner wall of the first housing and the inner surface of the inner wall of the second housing may be aligned with each other, or the inner surface of the inner wall of the first housing may be closer to at the center of rotation of the drum than the inner surface of the inner wall of the second housing.

The inner surface of the outer wall of the first housing and the inner surface of the outer wall of the second housing may be aligned with each other, or the inner surface of the outer wall of the second housing may be closer to the center of rotation of the drum than the inner surface of the outer wall of the first housing.

The outer surface of the outer wall of the second housing may be located on an outer side in a radial direction of the drum than the outer surface of the outer wall of the first housing. In the radial direction of the drum, the outer surface of the outer wall of the second housing may be positioned between the outer surface of the outer wall of the first housing and the outer circumferential surface of the drum.

The clothing treatment apparatus may further include a cabinet. The tub may be disposed in the cabinet.

The clothing treatment apparatus may further include a drawer disposed in the cabinet. The tub may be disposed in the drawer. The cabinet may have an outlet at a front. The drawer may be provided to be withdrawn from the cabinet through the outlet.

A clothing treatment apparatus according to an aspect of the present disclosure may include: a tub including a tub body having a cylindrical tub body to provide a space for storing water, and a tub cover forming an upper surface of the tub body; a cylindrical drum body rotatably provided inside the tub to provide a space for storing clothing and having an open upper surface; a first housing provided in a ring shape and fixed to an upper surface of the drum body; a second housing provided in a ring shape and fixed to an upper surface of the first housing; a first passage having a ring shape and formed in such a manner in which an upper surface of the first housing is provided as a groove bent concavely in a direction away from the tub cover to provide a space for storing a liquid; and a second passage coupled to the first passage to form a circulation passage of the liquid and formed in such a manner in which a bottom surface of the second housing is provided as a groove bent concavely toward the tub cover. A width of the first passage may be set to be wider than a width of the second passage.

A thickness of the first housing in a radial direction of the drum body may be set to be smaller than a thickness of the second housing in the radial direction of the drum body.

A point facing the circumferential surface of the tub body in both side surfaces of a lower end of the second passage and a point facing the circumferential surface of the tub body in both side surfaces of an upper end of the first passage may be connected so as not to form a step, and a point facing the center of the drum body in the both side surfaces of the lower end of the second passage and a point facing the center of the drum body in the both side surfaces of the upper end of the first passage may be connected so as to form a step.

point on both sides of the lower end of the second passage facing the circumferential surface of the tub body and a point on both sides of the upper end of the first passage facing the circumferential surface of the tub body are connected to form a step, and both sides of the lower end of the second passage A point facing the center of the drum body and a point facing the center of the drum body among both upper end surfaces of the first passage may be connected so as not to form a step difference.

A point on both sides of the lower end of the second passage facing the circumferential surface of the tub body and a point on both sides of the upper end of the first passage facing the circumferential surface of the tub body are connected to form a step, and both sides of the lower end of the second passage A point facing the center of the drum body and a point facing the center of the drum body among both upper end surfaces of the first passage may be connected to form a step difference.

A length of the second passage with respect to the height direction of the drum body may be equal to a length of the first passage with respect to the height direction of the drum body or may be set to be greater than the length of the first passage.

A height of the first housing may be set to be greater than a height of the second housing, and a center of gravity of the balancer may be set to a point located inside the first passage.

A height of the bottom surface of the circulation passage may be set to be lower than a height of an upper end of the drum body.

The clothing treatment apparatus may further include a plurality of anti-slip walls protruding from a surface facing the tub body toward a center of rotation of the drum body in an internal space of the circulation passage.

The clothing treatment apparatus may further include: a first partition wall provided in the first housing to divide the inside of the first passage into two spaces; and a second partition wall provided in the second housing to divide the inside of the second passage into two spaces and coupled to a free end of the first partition to divide the inside of the circulation passage into a first chamber and a second chamber.

The clothing treatment apparatus may further include: a fixed body protruding from a circumferential surface of the first housing to contact the circumferential surface of the drum body and fixing the first housing to the circumferential surface of the drum body; a balancer support part protruding from the circumferential surface of the drum body toward the center of the drum body; and a fastening groove formed at a circumferential surface of the fixed body and a corner of a bottom surface of the fixed body in a space provided by the fixed body, thereby providing a space for accommodating at least a portion of the balancer support part.

The balancer support part may have a semicircular or arc-shaped cross-section, and the fastening groove may be provided to accommodate an area above a horizontal line passing through the center of the balancer support part in the area of the balancer support part.

The clothing treatment apparatus may further include: a cabinet having an outlet at a front surface; and a drawer provided to be drawn out from the cabinet to provide a space in which the tub is accommodated.

A clothing treatment apparatus according to an aspect of the present disclosure may include: a cabinet; a tub having a cylindrical tub body provided inside the cabinet to provide a space for storing water, and a tub cover forming an upper surface of the tub body; a cylindrical drum body rotatably provided inside the tub to provide a space for storing clothing and having an open upper surface; a first housing provided in a ring shape and fixed to an upper surface of the drum body; a second housing provided in a ring shape and fixed to an upper surface of the first housing; a first passage provided in a ring shape and formed in such a manner in which an upper surface of the first housing is provided as a groove bent concavely in a direction away from the tub cover to provide a space for storing a liquid; a second passage coupled to the first passage to form a circulation passage of the liquid and formed in such a manner in which a bottom surface of the second housing is provided in a ring shape with a groove bent concavely toward the tub cover; a second cabinet provided to support a bottom surface of the cabinet; and a second drum provided inside the second cabinet to provide a space for storing clothing. A width of the first passage may be set to be wider than a width of the second passage.

A clothing treatment apparatus according to an aspect of the present disclosure may include a tub, a chamber, and a chamber drain pipe connected to the chamber.

The chamber may be formed to protrude from a bottom surface of the tub.

The chamber drain pipe may extend from a side surface of the chamber in a direction away from the center of the tub.

The clothing treatment apparatus may include a cabinet, a tub, a drum, and a driving part.

The tub may be provided inside the cabinet to provide a space for storing water, and may have a cylindrical shape with a width set to be greater than a height.

The drum may be rotatably provided inside the tub.

The driving part may be fixed to the bottom surface of the tub, positioned located outside the tub, and able to rotate the drum.

The clothing treatment apparatus may further include a drain pipe for guiding water discharged through the chamber drain pipe to the outside of the cabinet.

The chamber drain pipe may be coupled to one end of the drain pipe from the outside of the cylinder extending the outer circumferential surface of the tub and thus coupled thereto.

The clothing treatment apparatus may further include a drawer formed in the cabinet to be withdrawable and accommodating the tub therein.

The chamber drain pipe may extend in a direction inclined to a direction in which the drawer is withdrawn out from the cabinet.

The clothing treatment apparatus may further include a heater for heating water in the tub. The heater may be accommodated in the chamber.

The chamber may include a heating chamber accommodating the heater, and a water collecting chamber protruding from a bottom surface of the heating chamber toward a bottom surface of the cabinet to form a space in which water is stored.

The chamber drain pipe may extend in a direction away from the center of the tub from a side surface of the water collecting chamber.

A side surface and/or a bottom surface of the water collecting chamber may be inclined downward toward the chamber drain pipe.

The bottom surface of the tub may include a first bottom surface formed in the center of the tub, a second bottom surface formed outside the tub than the first bottom surface and located below the first bottom surface, and an inclined surface formed to be inclined downward from the first bottom surface toward the second bottom surface.

The driving part may be located below the first bottom surface.

The chamber may be formed to be spaced apart from the driving part and protrude from the second bottom surface to a bottom surface of the cabinet.

A height of a lowest point of the chamber drain pipe may be equal to a height of a lowest point of the driving part or higher than the height of the lowest point of the driving part with respect to the bottom surface of the cabinet.

A height of a lowest point of the chamber drain pipe may be equal to a height of a lowest point of the chamber or lower than the height of the lowest point of the driving part with respect to the bottom surface of the cabinet.

The height of the lowest point of the chamber drain pipe may be equal to the height of the lowest point of the driving part or higher than the height of the lowest point of the driving part with respect to the bottom surface of the cabinet.

According to at least one of the embodiments of the present disclosure, it is possible to provide a clothing treatment apparatus capable of maximizing the volume of a tub.

According to at least one of the embodiments of the present disclosure, it is possible to provide a clothing treatment apparatus capable of maximizing the volume of a drum.

According to at least one of the embodiments of the present disclosure, it is possible to provide a clothing treatment apparatus capable of maximizing the volume of a tub and a drum positioned inside a drawer whose width is set to be greater than a height.

According to at least one of the embodiments of the present disclosure, it is possible to provide a clothing treatment apparatus capable of easily controlling vibration of a tub and a drum.

According to at least one of the embodiments of the present disclosure, it is possible to provide a clothing treatment apparatus capable of minimizing a risk of damage to a drain pipe and a heating part provided at a bottom surface of a tub while maximizing the volume of the tub.

Further scope of applicability of the present disclosure will become apparent from the following detailed description. However, it should be understood that the detailed description and specific embodiments such as preferred embodiments of the present disclosure are given by way of example only, since various changes and modifications within the spirit and scope of the present disclosure can be clearly understood by those skilled in the art.

DESCRIPTION OF EXEMPLARY EMBODIMENTS

Figure 1:
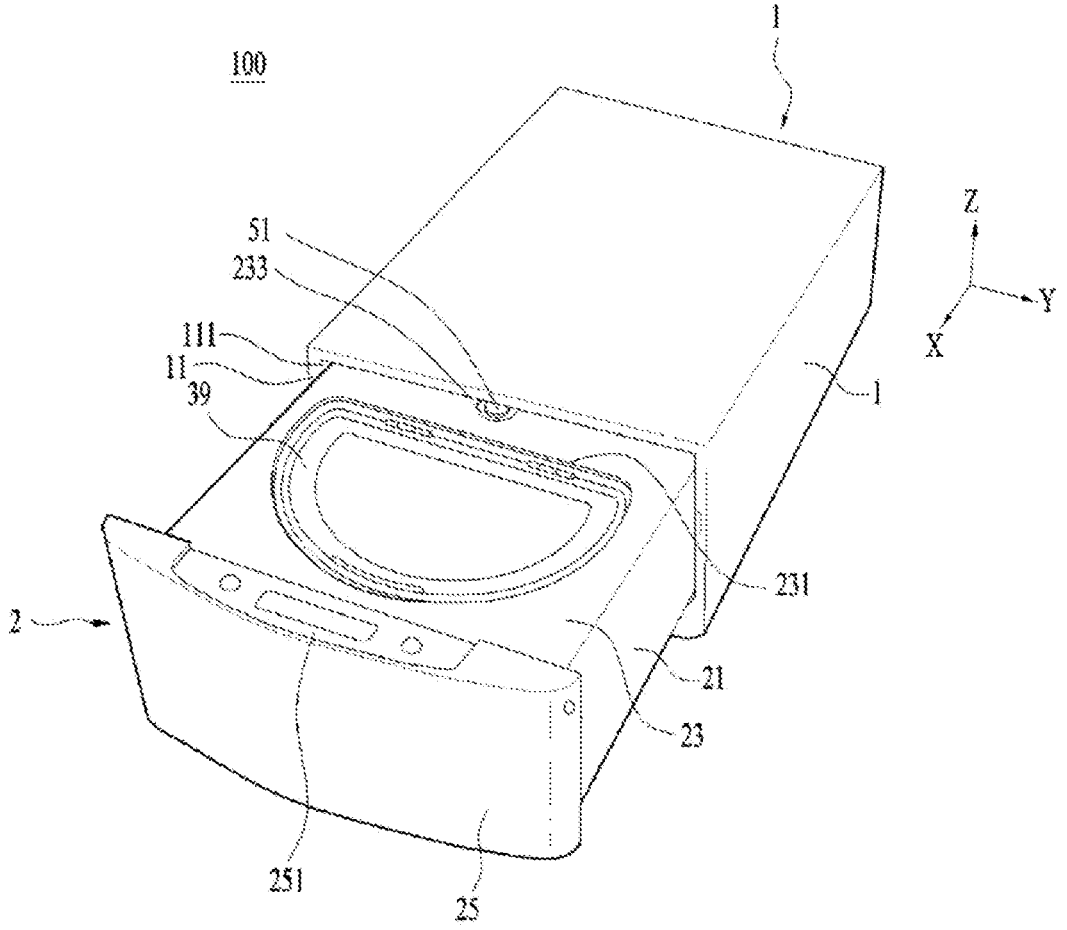
FIGS. 1 and 2 are views showing a clothing treatment apparatus according to an embodiment of the present disclosure.

Hereinafter, embodiments disclosed herein will be described in detail with reference to the accompanying drawings. Regardless of the reference numerals, the same or similar components are assigned the same reference numerals, and overlapping descriptions thereof will be omitted.

The suffixes "module" and "part" for components used in the following description are given or mixed in consideration of only the ease of writing the specification, and do not have distinct meanings or roles by themselves.

In addition, in describing the embodiments disclosed in the present specification, if it is determined that detailed descriptions of related known technologies may obscure the gist of the embodiments disclosed in this specification, the detailed description thereof will be omitted. In addition, the accompanying drawings are only for easy understanding of the embodiments disclosed in the present specification, and the technical spirit disclosed in the present specification is not limited by the accompanying drawings, and all changes included in the spirit and scope of the present disclosure, should be understood to include equivalents or substitutes.

Terms including ordinal numbers such as first, second, etc. may be used to describe various elements, but the elements are not limited by the terms. The above terms are used only for the purpose of distinguishing one component from another.

When a component is referred to as being "connected" or "connected" to another component, it may be directly connected or connected to the other component, but it is understood that other components may exist in between. When a component is referred to as being "directly connected" or "directly accessed" to other component, it should be understood that there is no component therebetween.

The singular expression includes the plural expression unless the context clearly dictates otherwise.

Referring to FIG. 1, in a clothing treatment apparatus 100 according to an embodiment of the present disclosure may include a cabinet 1 having an outlet 111 on a front surface 11 thereof, and a drawer 2 drawable from the cabinet 1 through the outlet 111.

A tub 3 (see FIG. 2) to be described later may be provided inside the drawer to provide a space for storing water.

A drum 4 (see FIG. 2) to be described later may be rotatably provided inside the tub.

The drawer 2 may include a drawer body 21, a drawer cover 23 forming an upper surface of the drawer body, and a drawer panel 25 fixed to the drawer body 21.

The drawer body 21 may be provided in a hexahedral shape having an open upper surface. The drawer cover 23 may be fixed to an upper end of the drawer body 23 to form an upper surface of the drawer 2.

The drawer panel 25 may be a means (cabinet door) for opening and closing the outlet 111. The drawer panel 25 may be a means (handle) for facilitating withdrawal of the drawer body 21 from the cabinet 1 or insertion of the drawer body 21 into the cabinet 1.

A control panel 251 for controlling the operation of the clothing treatment apparatus 100 may be provided at an upper surface of the drawer panel 25. The control panel 251 may be a means for receiving a control command required for operation of the clothing treatment apparatus from a user. For example, the control panel may be a means (a water supply part, a draining part) for receiving from a user a control command required for operation of a means for supplying or draining water to or from the tub 3, a means for rotating the drum 4 (driving part), or the like. For example, the control panel 251 may be provided with an input part for allowing the user to input a control command to the clothing processing apparatus, and a display part for notifying the user of confirmation of the control command input through the input part or execution of the control command input by the user.

The drawer cover 23 may be provided with an inlet 231 passing through the drawer cover 23 and communicating with the inside of the drawer body 21. The drawer cover 23 may be provided with a cover through-hole 233 passing through the drawer cover 23 and having a water supply pipe 51 (see FIG. 2), which will be described later, inserted thereinto.

The cabinet 1 may have a length in a width direction (Y-axis direction) longer than a length in a height direction (Z-axis direction) (which means that the length in the width direction of the drawer may be longer than the length in the height direction).

Accordingly, the clothing treatment apparatus 100 may be positioned below or above another treatment apparatus capable of washing or drying clothing.

Accordingly, it may be easy for a user to access the control panel 251 and the inlet 231.

Figure 2:
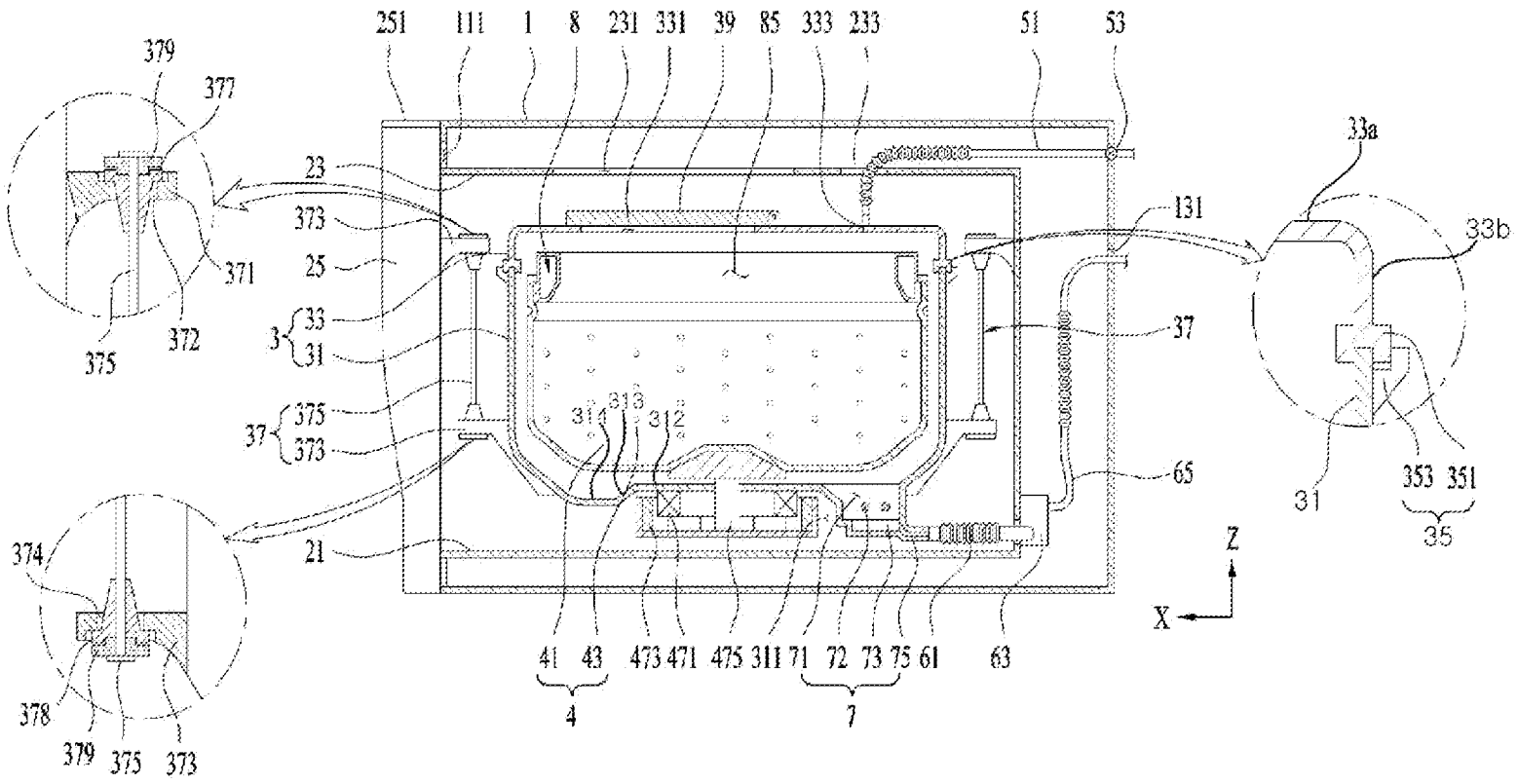

Referring to FIG. 2, the clothing treatment apparatus according to an embodiment of the present disclosure may include a tub 3. The tub 3 may extend in a cylindrical shape. The tub 3 may have a diameter greater than a length (height) thereof. The tub 3 may provide a space in which water is stored. The tub 3 may be disposed in the drawer 2.

The tub 3 may include a tub body 31 extending in a cylindrical shape having a diameter greater than a length. The tub body 31 may be opened upward.

The tub 3 may include a cover 33*a* forming an upper surface of the tub 3. The tub 3 may include an extension 33*b* extending downward from an edge of the cover 33*a*. The extension 33*b* may be coupled to an upper portion of the tub body 31. A tub cover 33 may be referred to as including the cover 33*a* and the extension 33*b*. Hereinafter, the cover 33*a* may be also referred to as a cover body 33*a*. Hereinafter, the extension 33*b* may be also referred to as an extension body 33*b*.

The tub body 31 may be provided in a cylindrical shape with an open upper surface. A width of the drawer body 21 may be set to be greater than a height of the drawer body, and a width of the tub body 31 may be set to be greater than a height of the tub body.

The tub body 31 may be supported inside the drawer body 21 through a tub support part 37. The tub support part 37 may include a first bracket 371 protruding from the drawer body 21 toward a circumferential surface of the tub body 31, a second bracket 373 protruding from the circumferential surface of the tub body 31 toward a side surface of the drawer body and provided at a lower position than that of the first bracket 371, and a support bar 375 having one end (an upper end) connected to the first bracket 371 and the other end (a lower end) connected to the second bracket 373.

The support bar 375 may be connected to the first bracket 371 through a first connecting portion 377, and may be connected to the second bracket 373 through the second connecting portion 378. The first connecting portion 377 may be provided such that one end is supported by the first bracket 371 and the other end passes through the first bracket through-hole 372 to thereby pass through the first bracket 371. The second connecting portion 378 may be provided such that one end supports the second bracket 373 and the other end passes through the second bracket through-hole 374 to thereby pass through the second bracket 373. The support bar 375 may be provided as a bar passing through the first connecting portion 377 and the second connecting portion 378.

An elastic body 379 may be further provided between an upper end of the support bar 375 and the first connecting portion 377 and between a lower end of the support bar 375 and the second connecting portion 378. The elastic body 379 may be provided as a pad formed of rubber or the like. Using the elastic body, the clothing treatment apparatus 100 may damp vibration of the tub body 31.

The tub support part 37 having the above-described structure may be provided in a plurality of units, which are spaced apart from each other at the same angle with reference to a vertical line passing through the center of the tub body 31.

The tub cover 33 may include a cover body 33*a* positioned below the inlet 231. The tub cover 33 may include an extension body 33*b* bent from the circumferential surface of the cover body toward a top of the tub body 31.

Accordingly, it is possible to increase a height and a capacity of the tub 3.

Accordingly, it is possible to increase the height and capacity of the tub 3 without changing the design of an existing tub body 31.

The cover body 33*a* may be provided with a tub inlet 331 and a water supply port 333 for communicating an inner space of the tub body 31 with the outside. The tub inlet 331 may be provided to be opened and closed by a door 39 that is rotatably coupled to the cover body 33*a*. The door 39 may be positioned below the inlet 231. The door 39 may be rotated in a direction to open the tub inlet 331 when the drawer is withdrawn from the cabinet. One end of the water supply pipe 51 to be described later may be fixed to the water supply port 333.

The extension body 33*b* may be fixed to an upper end of the tub body 31. The extension body 33*b* may be fixed to the upper end of the tub body 31 with a cover fastening portion 35.

The cover fastening part 35 may include a first fastening portion 351 provided at a free end of the extension body 33*b* to provide a space in which the top of the tub body 31 is accommodated, and a second fastening portion 353 provided at the circumferential surface of the tub body 31 and coupled to the first fastening portion 351.

The tub 3 is supplied with water through a water supply part. The water supply part may include the water supply pipe 51 connecting the water supply port 333 and a water supply source located outside the cabinet, and a water supply valve 53 for regulating opening and closing of the water supply pipe in accordance with a control signal from a controller.

Water stored in the tub 3 may be discharged to the outside of the cabinet 1 through a drain part. The drain part may include a first drain pipe 61 connecting a bottom surface of the tub body 31 and a drain pump 63, and a second drain pipe 65 guiding water discharged from the drain pump 63 to the outside of the cabinet 1. A cabinet through-hole 131 through which the second drain pipe 65 passes may be provided at a rear surface of the cabinet.

The drum 4 may be rotatably provided inside the tub 3. The drum 4 may extend in a cylindrical shape. The drum 4 may have a diameter greater than a length (height) thereof. The drum 4 may be opened upward. The drum 4 may provide a space in which clothing are stored.

The drum 4 may include a drum body 41 that provides a space in which the clothing are stored. The drum body 41 may be provided in a cylindrical shape with an open upper surface or a cylindrical shape having a through-hole formed in an upper surface.

A plurality of communication holes 43 for communicating the inside of the drum body 41 with the inside of the tub 3 may be provided in at least one of a circumferential surface and a bottom surface of the drum body 41.

The above-described drum body 41 is rotated by a driving part. The driving part may be fixed to a bottom surface of the tub 3 from the outside of the tub 3.

The driving part may include a stator 471 fixed to the bottom surface of the tub body 31 and positioned outside the tub 3, a rotor 473 rotated by a rotating magnetic field provided by the stator 471, and a rotational shaft 475 connecting the drum body 41 and the rotor 473 through the bottom surface of the tub body 31. As shown in the drawings, the rotational shaft 475 may be provided to form a right angle with respect to the inlet 231 (to form a right angle with respect to the bottom surface of the tub body).

A balancer 8 may be provided at an upper end of the drum body 41. The balancer 8 may damp vibration generated in the drum body at the event of rotation of the drum body 41.

Figure 3:
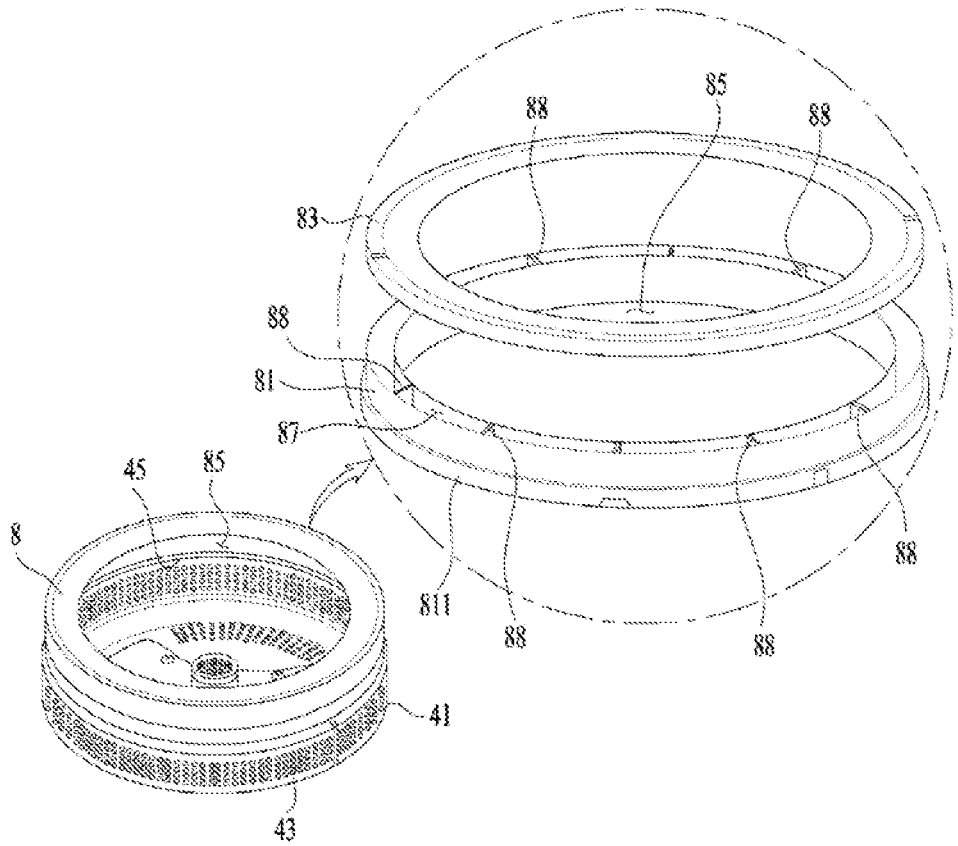
FIGS. 3 to 4 show an example of a balancer according to an embodiment of the present disclosure.

Referring to FIG. 3, the balancer 8 may be fixed to the drum 4. The balancer 8 may be fixed to an upper portion of the drum 4. The balancer 8 may extend along a circumference of the drum 4. The balancer 8 may extend in a circumferential direction of the drum 4. The balancer 8 may be fixed to an upper portion of the drum body 41 to be rotated integrally with the drum 4, and may extend along the circumference of the drum 4. That is, it can be seen that the balancer 8 forms the upper portion of the drum 4.

Accordingly, it is possible to increase a height and a capacity of the drum 4.

Accordingly, it is possible to increase the height and the capacity of the drum 4 without changing the design of an existing drum body 41.

The balancer 8 may include a housing 81 and 83 fixed to the drum body 41 to form an upper surface of the drum body, and a housing through-hole 85 passing through the housing. The housing through-hole 85 passing through the housing 81 and 83 may mean that the housing 81 and 83 has a ring shape.

A circulation passage 87 provided in a ring shape inside the housing to form a movement path of liquid may be included. Liquid may be stored in the circulation passage 87. Hereinafter, the circulation passage 87 is also referred to as a chamber 87.

Since the housing through-hole 85 is positioned below the tub inlet 331, clothing fed through the tub inlet 331 moves into the drum body 41 through the housing through-hole 85. Accordingly, the housing through-hole 85 serves as a drum inlet. Hereinafter, the housing through-hole 85 may be also referred to as a channel 85.

The housing may include a first housing 81 provided in a ring shape, and a second housing 83 provided in a ring shape and fixed to an upper surface of the first housing 81. An upper end of the first housing 81 and an upper end of the second housing 83 may be coupled by thermal fusion.

The balancer 8 may further include a fixed body 811 provided at a circumferential surface of the first housing 81 to fix the first housing 81 to the circumferential surface of the drum body 41.

Figure 4:
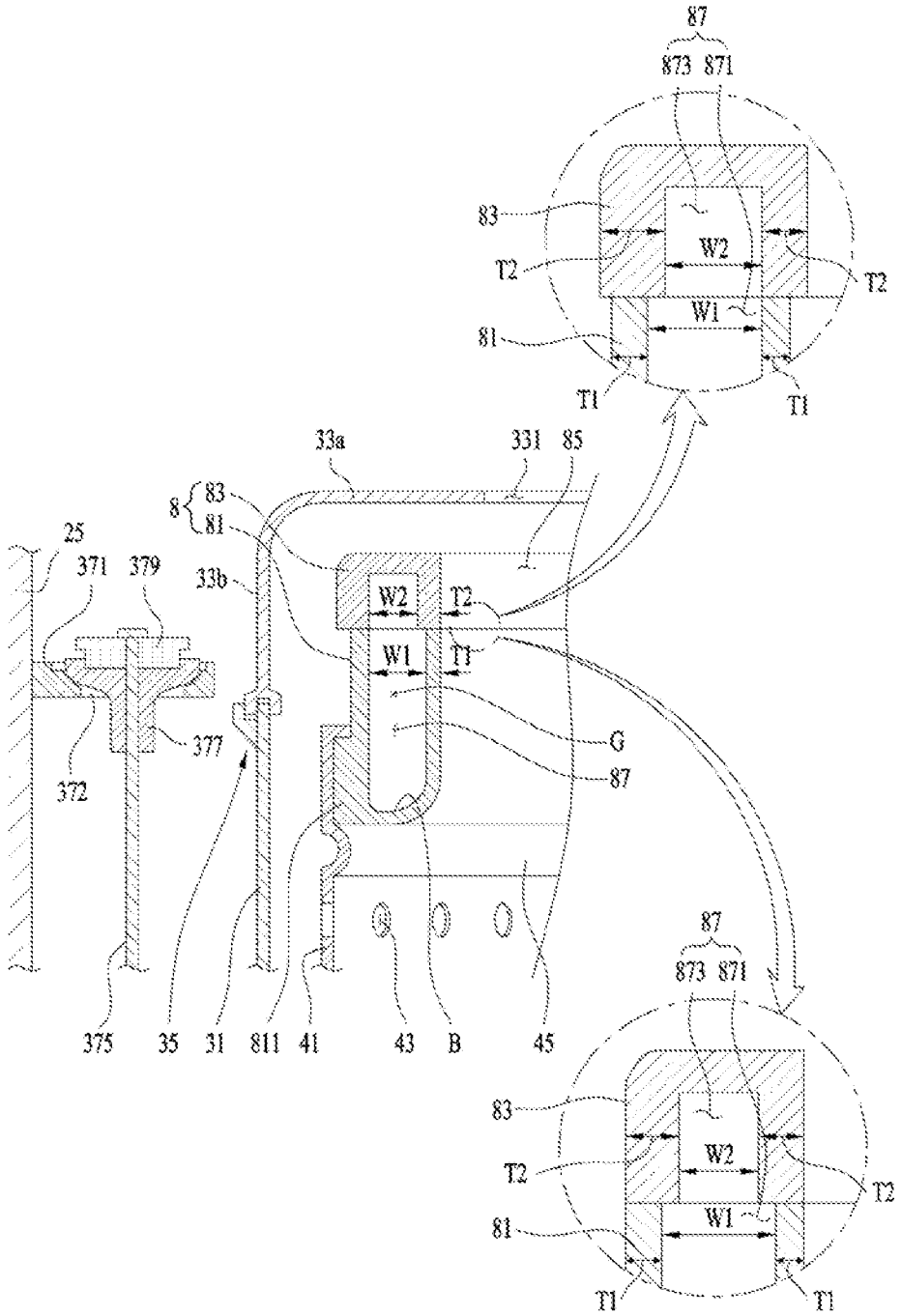

Referring to FIG. 4, a lower end of the first housing 81 may be inserted into the drum body 41, and an upper end of the first housing 81 may be exposed to the outside of the drum body 41.

The fixed body 811 may protrude in a ring shape from one surface of the first housing 81 (a side surface of the first housing) facing the circumferential surface of the drum body 41 toward the circumferential surface of the drum body 41. That is, a diameter of the fixed body 811 may be set to be greater than a diameter of a lower end of the first housing 81 (a diameter of the fixed body may be set to be equal to a diameter of an opening in an upper surface of the drum body 41, and a diameter of a lower end of the first housing may be set to be smaller than a diameter of the fixed body).

The first housing 81 may be provided with a ring-shaped first passage 871 in which an upper surface of the first housing is depressed toward a direction away from the cover body 33*a*. The second housing 82 may include a ring-shaped second passage 873 in which a bottom surface of the second housing 83 is recessed toward the cover body 33*a*. The circulation passage 87 may be formed by connecting the first passage 871 and the second passage 873 to each other. Hereinafter, the first passage 871 may be also referred to as a first chamber 871. Hereinafter, the second passage 872 may be also referred to as a second chamber 873.

In the balancer 8 having the above-described structure, an amount of liquid moving along the circulation passage may vary according to a volume of the circulation passage 87. When the same liquid is used, a larger volume of the circulation passage 87 is more advantageous in reducing the eccentricity and vibration of the drum 4. In addition, if a height of the housing 81 and 83 is increased to increase the volume of the circulation passage 87, a length of the drum body 41 will be increased, thereby bringing the effect of increasing the volume of the drum body 41 (which is the effect of increasing a capacity of treating clothing).

Meanwhile, the above-described effect can be expected by increasing the height of the housings 81 and 83 and the volume of the circulation passage, but when a height of the center of gravity G of the balancer 8 is increased, the upper portion of the drum 4 and the upper portion of the tub 3 may vibrate more greatly. When the height of the center of gravity G of the balancer 8 is increased, a distance between a lower end of the tub support part 37 and the center of gravity G is increased (which means that a distance between a support point formed by the tub support part and the center of gravity of the entire drum is increased). This means that a distance (a length of the moment arm) perpendicular to a force acting on the center of gravity G from the lower end of the tub support part 37 (a force generated when liquid moves along the inside of the circulation passage) is increased, and the increased length of the moment arm means the upper end of the tub 3 possibly becomes to vibrate more greatly.

A width W1 of the first passage 871 may be wider than a width W2 of the second passage 873. Accordingly, it is possible to minimize the height of the center of gravity G of the balancer while increasing the volume of the circulation passage and the height of the housing.

Making the width W1 of the first passage wider than the width W2 of the second passage may be implemented in various ways. For example, as shown in FIG. 4, by setting a thickness T1 of the first housing with respect to a radial direction of the drum body 41 to be smaller than a thickness T2 of the second housing with respect to the radial direction of the drum body 41, the width W2 of the second passage may be designed to be wider than the width W1 of the first passage. That is, in FIG. 4, by setting the thickness T1 of both side walls of the first housing 81 forming the first passage 871 to be smaller than the thickness T2 of both side walls of the second housing 83 forming the second passage 873, the width W2 of the second passage may be wider than the width W1 of the first passage.

In this case, a point facing the circumferential surface of the tub body 31 in both side surfaces of a lower end of the second passage 83 and a point facing the circumferential surface of the tub body 31 in both side surfaces of an upper end of the first passage 81 may be connected so as not to form a step, and a point facing the center of the drum body 41 in the both side surfaces of the lower end of the second passage 83 and a point facing the center of the drum body in the both side surfaces of the upper end of the first passage 81 may be connected so as to form a step.

Or, a point facing the circumferential surface of the tub body in both side surfaces of a lower end of the second passage and a point facing the circumferential surface of the tub body in both side surfaces of an upper end of the first passage may be connected so as not to form a step, and a point facing the center of the drum body in the both side surfaces of the lower end of the second passage and a point facing the center of the drum body in the both side surfaces of the upper end of the first passage may be connected so as to form a step.

Or, as shown in an enlarged view shown in a lower right side of FIG. 4, the both side surfaces of the lower end of the second passage 83 and the both side surfaces of the upper end of the first passage 81 may be connected so as to form a step.

A height of a bottom surface B of the circulation passage 87 (a height of a bottom surface of the first passage) may be set to be lower than a height of an upper end of the drum body 41. Accordingly, it is possible to move the height of the center of gravity G of the balancer downward.

In addition, a width of the circulation passage 87 may be set to be shorter than a height of the circulation passage (a length of the circulation passage parallel to a height direction of the drum body). Accordingly, it is possible to increase the volume of the circulation passage 87 without reducing the volume of the drum 4.

As shown in the drawings, the center of gravity G of the balancer may be set to be located inside the first passage 871. A height of the first housing 81 may be set to be longer than a height of the second housing 83.

Unlike the drawings, a length of the second passage 83 with respect to the height direction of the drum body 41 may be equal to a length of the first passage 41 with respect to the height direction of the drum body 41 or may be set to be greater than the length of the first passage 41. This is to minimize the design change required for manufacturing the balancer 8 (a change in the structure of a mold for manufacturing the housing and a change in the structure of the drum).

When the drum body 41 is rotated at a high rotational speed (a rotational speed causing a centrifugal force of 1G or more), it is preferable that the liquid not move along the circulation passage unless the vibration of the drum body exceeds a preset reference vibration. This is because, if the liquid moves inside the circulation passage while rotating at the rotational speed in which centrifugal force greater than gravity 1G is induced in a radial direction of the drum body, vibration according to the movement of the liquid may occur in the drum body 41.

A plurality of anti-slip walls may be provided in the circulation passage 87. Accordingly, it is possible to prevent the liquid from moving along the circulation passage while the drum body 41 is rotated at a high speed.

As shown in FIG. 3, one ends of the anti-slip walls 88 may be fixed to an outer circumferential surface of the circulation passage 87 (a surface facing the circumferential surface of the tub body), and free ends thereof may be provided as boards protruding toward an inner circumferential surface of the circulation passage 87 (a surface facing the center of the drum body). The free ends of the anti-slip walls 88 may not contact the inner circumferential surface of the circulation passage 87. When the drum body 41 is rotated at a low speed or when the drum body 41 is rotated eccentrically, the liquid may move along the circulation passage.

The anti-slip walls 88 may be provided as a plurality of boards spaced apart from each other at the same angle with respect to the center of the housing through-hole 85.

Figure 5:
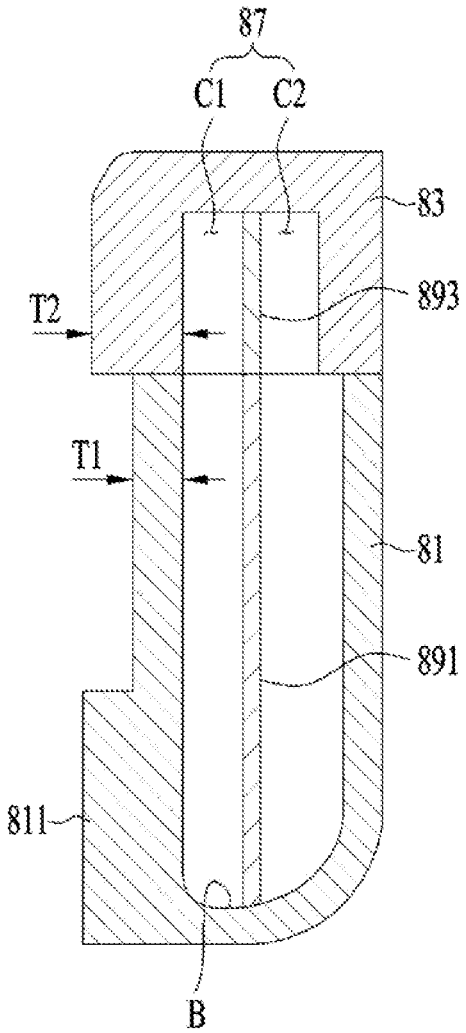
FIGS. 5 to 6 show a balancer according to an embodiment of the present disclosure.

Referring to FIG. 5, the circulation passage 87 may be divided into two chambers C1 and C2 by a partition wall 89. The liquid may be stored in an outer chamber C1 and an inner chamber C2, individually.

The partition wall 89 may include a first partition wall 891 provided in the first housing 81 to divide the inside of the first passage 871 into two spaces, and a second partition wall 893 provided in the second housing 83 to divide the inside of the second passage 873 into two spaces. In this case, a free end of the first partition wall 891 and a free end of the second partition wall 893 may be coupled to each other by thermal fusion.

Figure 6:
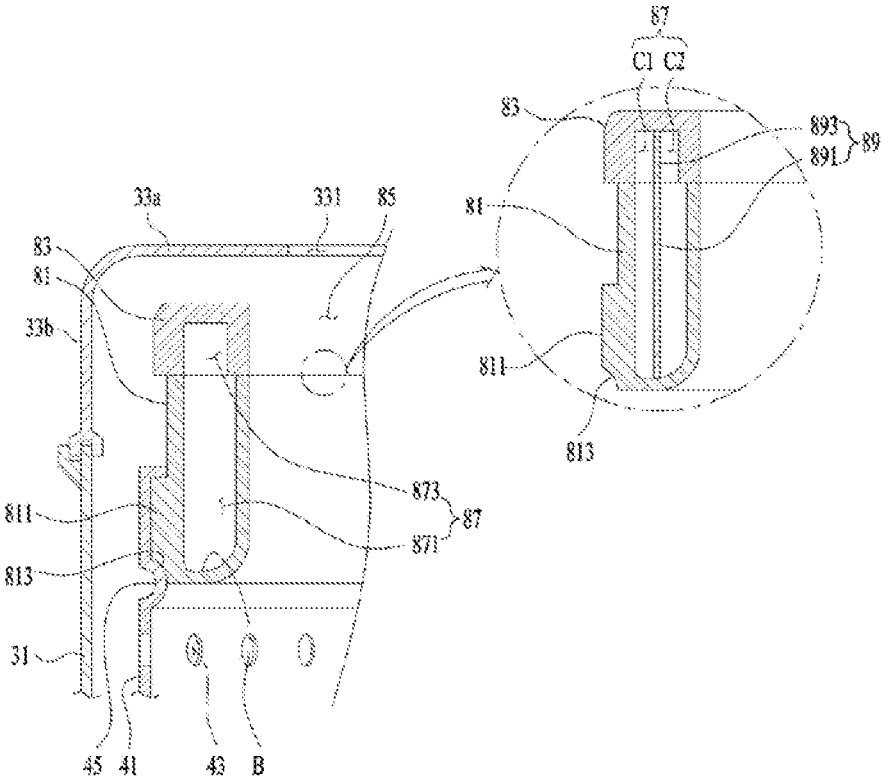

Referring to FIG. 6, the drum 4 may include a balancer support part 45 protruding from the circumferential surface of the drum body 41 toward the center of the drum body. The balancer 8 may include a fastening groove 813 formed as a concavely bent groove by the circumferential surface of the first housing 81 to form a space in which the balancer support part 45 is accommodated.

The fastening groove 813 may be formed in a circumferential surface of the fixed body and a corner of a bottom surface of the fixed body in the space provided by the fixed body 811 to thereby accommodate at least a portion of the balancer support part 45.

The balancer support part 45 may extend along a circumference of the drum 4 and may have a semicircular or arc-shaped cross-section. The fastening groove 813 may be provided to accommodate an area above a horizontal line passing through the center of the balancer support part 45 in the area of the balancer support part 45 When the fastening groove 813 is provided in the fixed body 811, there is an effect that the height of the center of gravity G of the balancer can be further lowered. The circulation passage 87 shown in FIG. 6 may also be divided into the outer chamber C1 and the inner chamber C2 by the partition wall 89.

A heating part 7 for heating water inside the tub 3 may be further provided at the bottom surface of the tub body 31 to wash clothing with water at a temperature higher than room temperature.

Referring to FIG. 2, the heating part 7 may be accommodated in a tub chamber 71 and 73 protruding from the bottom surface of the tub toward the bottom surface of the cabinet.

The heating part 7 may include a heater 72 for heating water in the tub, and a chamber drain pipe 75 connected to the tub chamber 71 and 73.

The tub chamber 71 and 73 may be formed in the shape of a groove protruding from the bottom surface of the tub body 31 (which is a groove protruding from the bottom surface of the tub body toward the bottom surface of the cabinet, or a groove protruding from the bottom surface of the tub body toward the bottom surface of the drawer body).

The bottom surface of the tub body 31 may be inclined toward the tub chamber 71 and 73 so that water remaining at the bottom of the tub body 31 is able to move to the tub chamber 71 and 73.

The tub chamber 71 and 73 may include a heating chamber 71 for accommodating the heater 72 therein, and a water collecting chamber 73 protruding from the heating chamber 71 from the bottom surface of the heating chamber 71 toward the bottom surface of the cabinet 1 to store water.

Figure 7:
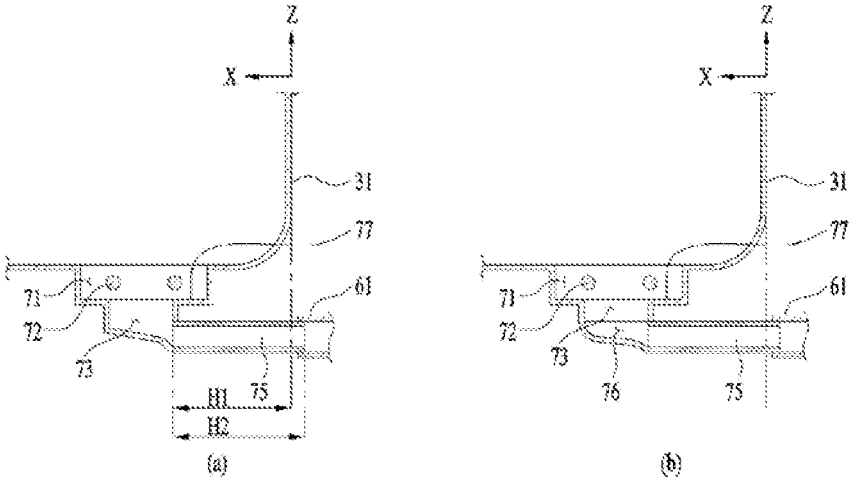
FIGS. 7 to 10 show an example of a heating part and a draining part according to an embodiment of the present disclosure.

Referring to (a) of FIG. 7, the water collecting chamber 73 may be provided as a space for storing water as a bottom surface of the heating chamber 71 protrudes toward the bottom surface of the drawer body 21 or the bottom surface of the cabinet 1.

The chamber drain pipe 75 may be in the form of a pipe passing through a side surface of the water collecting chamber 73. The chamber drain pipe 75 may be a pipe extending from a side surface of the water collecting chamber 73 in a radial direction of the tub body 31. The chamber drain pipe 75 may be a pipe extending in a direction away from the circumferential surface of the tub body 31 from a side surface of the water collecting chamber 73 (−X-axis direction).

Accordingly, it is possible to maximize the volume of the tub 3 and the drum 2.

Meanwhile, unlike the drawings, when the chamber drain pipe 75 is provided at the bottom surface of the water collection chamber 73, the first drain pipe 61 fixed to the chamber drain pipe 75 may be located at a bottom surface of the drawer body 21 or in a space between the bottom surface of the cabinet 1 and the chamber drain pipe 75.

In this state, when vibration occurs in the tub body 31 due to rotation of the drum body 41, the chamber drain pipe 75 and the first drain pipe 61 may be possibly damaged due to friction with the bottom surface of the drawer body 21 or the bottom surface of the cabinet 1.

When the chamber drain pipe 75 is provided at a side surface of the water collecting chamber 73, it is possible to minimize damage to the chamber drain pipe 75 at the event of vibration of the tub body 31. That is, as shown in (a) of FIG. 7, when the chamber drain pipe 75 is provided as a pipe extending in a direction away from the center of the tub, the above-described risk may be minimized.

The chamber drain pipe 75 may be coupled to one end of the first drain pipe 61. The chamber drain pipe 75 may be coupled to the first drain pipe 61 in such a way of being inserted into one end of the first drain pipe 61.

One end of the first drain pipe 61 may be fixed to the chamber drain pipe 75, and the other end thereof may be connected to the drain pump 63. The drain pump 63 may be fixed to the same position as that of the chamber drain pipe 75 or at a lower position than that of the chamber drain pipe 75.

When the chamber drain pipe 75 is provided as a pipe extending in a direction away from the center of the tub 3 from a side surface of the chamber 71 and 73, it is possible to prevent damage to the first drain pipe 61 at the event of vibration of the tub body 31.

The chamber drain pipe 75 may be positioned between the bottom surface of the tub 3 and a lowest point of the driving part. The chamber drain pipe 75 may be located between the bottom surface of the tub 3 and a lowest point of the rotor. A height of a lowest point of the chamber drain pipe 75 may be equal to a height of a lowest point of the rotor 473 or may be higher than the height of the lowest point of the rotor 473 (see FIG. 2).

Accordingly, it is possible to prevent damage to the chamber drain pipe 75 at the event of vibration of the tub body 31.

Meanwhile, referring to (a) of FIG. 7, the height of the lowest point of the chamber drain pipe 75 may be lower than a height of a lowest point of the water collecting chamber 73.

A side and/or bottom surface of the water collecting chamber 73 may be inclined downward toward the chamber drain pipe 75, and a bottom surface 77 (a first inclined surface) of the heating chamber 71 may be inclined downward toward the water collecting chamber 73.

Accordingly, it is possible to minimize residual water in the heating chamber 71 and the water collecting chamber 73.

The chamber drain pipe 75 may be coupled to one end of the first drain pipe 61 outside a virtual cylinder that extends an outer circumferential surface of the tub body 31.

The chamber drain pipe 75 may have one end coupled to a side surface of the water collecting chamber 73, and the other end thereof may be a free end.

A distance H1 from a side surface of the water collecting chamber 73 to the free end of the chamber drain pipe 75 may be greater than a distance H2 from a side surface of the water collecting chamber 73 to the circumferential surface of the tub body 31.

The chamber drain pipe 75 may be coupled to the first drain pipe 61 at a position further outside than an outer circumferential surface of the tub body 31 with reference to the center of the tub body 31.

Accordingly, a position where the chamber drain pipe 75 and the first drain pipe 61 are coupled may be located outside the outer circumferential surface of the tub, thereby maximizing the volume of the tub 3 and the drum 2.

Figure 8:
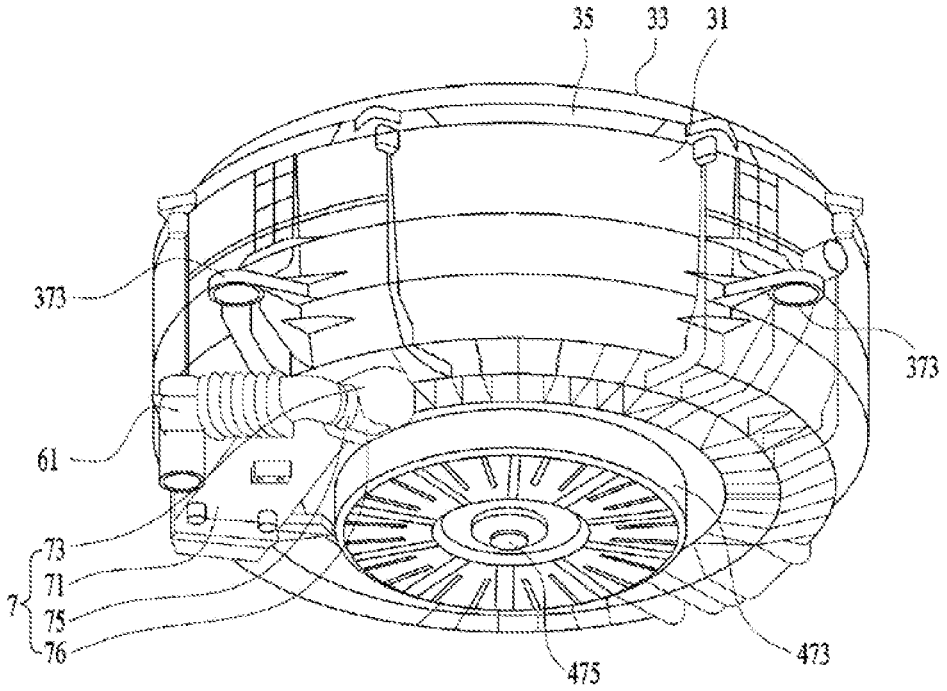

Referring to (b) of FIG. 7 and FIG. 8, the heating part 7 may further include a guide 76 protruding from a bottom surface of the water collecting chamber 73 to form a passage for guiding water to the chamber drain pipe 75.

Referring to (b) FIG. 7, a lowest point of the guide 76 (a lowest point in a bottom surface of the guide) may be located at a position lower than a lowest point of the water collecting chamber 73 with reference to the bottom surface of the cabinet 1 or the bottom surface of the drawer 2. A lowest point of the chamber drain pipe 75 (a lowest point in a bottom surface of the chamber drain pipe) may be lower than a lowest point of the guide 76 with reference to the bottom surface of the cabinet 1 or the bottom surface of the drawer 2.

Accordingly, it is possible to minimize an amount of water remaining in the water collection chamber 73.

A bottom surface of the guide 76 may be inclined downward toward the chamber drain pipe 75.

Figure 9:
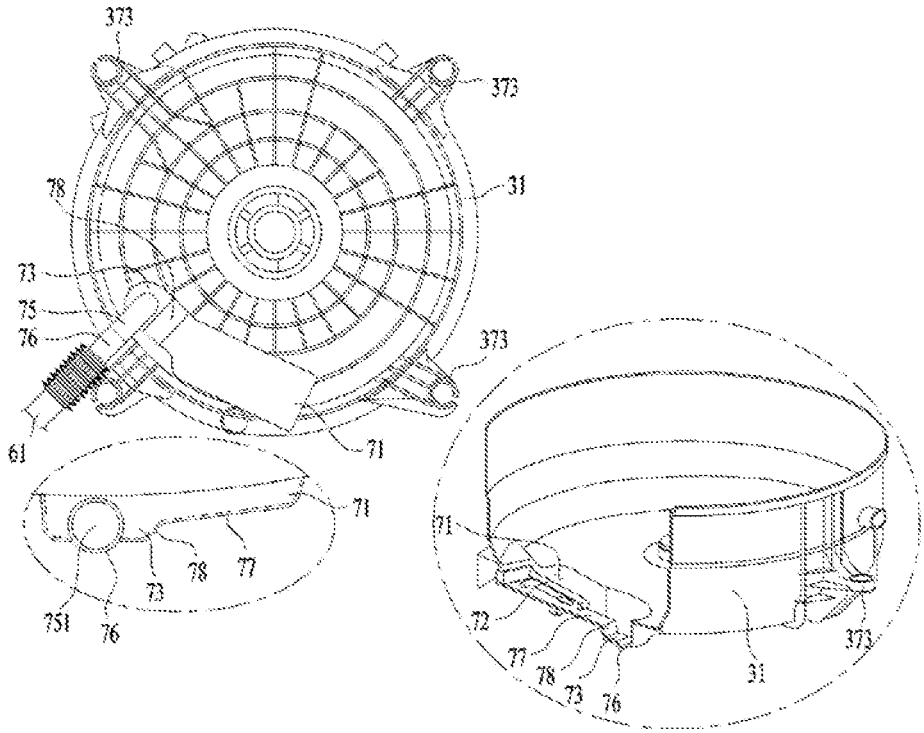

Referring to FIG. 9, a cross-section of the guide 76 may be provided in a semicircle or arc shape.

A surface 78 (a side surface of the water collecting chamber) connecting the bottom surface 77 of the heating chamber 71 and the bottom surface of the water collecting chamber 73 may be inclined further toward the chamber drain pipe 75 in a direction from the bottom surface 77 of the heating chamber 71 to the bottom surface of the water collecting chamber 73.

As the lowest point of the chamber drain pipe 75 is closer to the bottom surface of the drawer 2 or the bottom surface of the cabinet 1, the chamber drain pipe 75 and the first drain pipe 61 may be more likely damaged at the event of vibration of the tub body 31. In order to increase the height of the lowest point of the chamber drain pipe 75, a center 751 of the chamber drain pipe 75 may be located at a position higher than the bottom surface of the water collecting chamber 73.

As shown in FIGS. 1, 2, and 9, the chamber drain pipe 75 may extend in a direction ((−X-axis and +Y-axis directions) that is inclined to a direction in which the drawer 2 is to be withdrawn out from the cabinet 1 (+X-axis direction). The chamber drain pipe 75 may extend from a side surface of the chamber 71 and 73 in a direction away from the center of the tub 3, and may extend near a corner area where the side surface and the rear surface of the drawer 2 meet.

The chamber drain pipe 75 may extend in a direction in which the second bracket 373 protrudes. The chamber drain pipe 75 may extend from a side surface of the chamber 71 and 73 in a direction away from the center of the tub 3, and in a direction in which the second bracket 373 protrudes from the outer circumferential surface of the tub body 31 toward a side surface and/or rear surface of the drawer body.

Accordingly, as the chamber drain pipe 75 extends to or near an edge of the cabinet 1 or drawer 2, it is possible to minimize a volume of the tub 3 from being reduced by the chamber drain pipe 75 and to maximize the volume of the tub 3 and the drum 2.

A driving part mounting groove 311 protruding toward the tub cover 33 may be further provided at the bottom surface of the tub body 31.

As shown in FIG. 2, the driving part may be located inside the driving part mounting groove 311. The stator 471 and the rotor 473 may be located inside the driving part mounting groove 311. In this case, the lowest point of the chamber drain pipe 75 may be located between the lowest point of the rotor 473 and the bottom surface of the tub body 31.

As shown in FIG. 2, the bottom surface of the tub body 31 may include a first bottom surface 312, a second bottom surface 314, and an inclined surface 313. The driving part mounting groove 311 may be formed by the first bottom surface 312, the inclined surface 313, and the second bottom surface 314.

The first bottom surface 312 may be formed in the center of the tub body 31. The first bottom surface 312 may be formed in an area within a predetermined distance from the center of the tub body 31.

The second bottom surface 314 may be formed on an outer side than the first bottom surface 312 with respect to the center of the tub body 31. The second bottom surface 314 may be located below the first bottom surface 312. The second bottom surface 314 may be positioned lower than the first bottom surface 312 with respect to the bottom surface of the cabinet 1 or the bottom surface of the drawer 2.

The inclined surface 313 may be formed to be inclined downward from the first bottom surface 312 to the second bottom surface 314.

The driving part may be located below the first bottom surface 312. The stator 471 and the rotor 473 may be located below the first bottom surface 312.

The chambers 71 and 73 may be spaced apart from the driving part and protrude from the second bottom surface 314 toward the bottom surface of the cabinet 1 or the bottom surface of the drawer 2.

With reference to the first bottom surface 312, the second bottom surface 314 and the chambers 71 and 73 are located at a lower position, thereby minimizing a reduction in the volume of the tub 3 so as to secure a space for the installation of the heating part 7 and maximizing the volume of the tub 3 and the drum 2.

Figure 10:
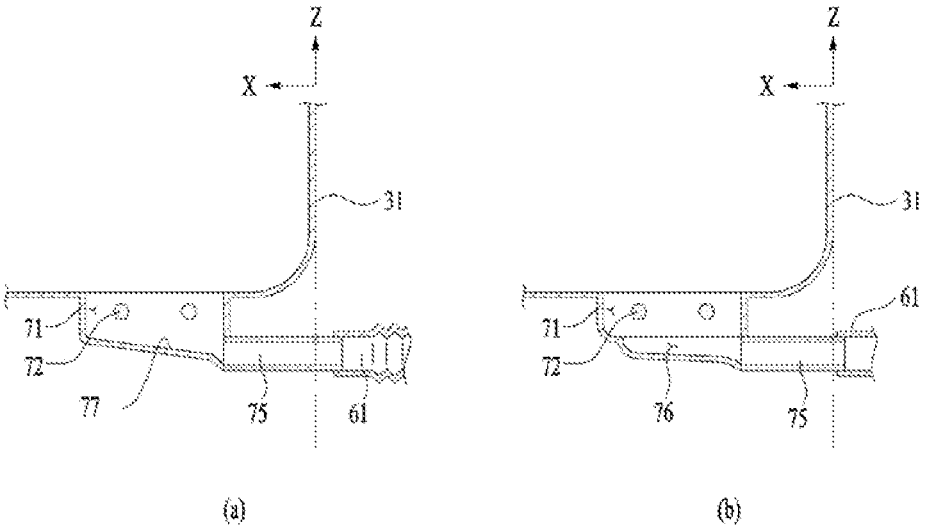

Referring to FIG. 10, the heating part 7 may not include the water collecting chamber 73.

Referring to (a) of FIG. 10, the heating part 7 may include a heating chamber 71 protruding from the bottom surface of the tub body 31 to form a space in which the heater 72 is accommodated, and a chamber drain pipe 75 connected to the heating chamber 71.

The chamber drain pipe 75 may include the chamber drain pipe 75 extending from a side surface of the heating chamber 71 in a radial direction of the tub body 31 to discharge the water stored in the heating chamber 71.

Accordingly, it is possible to maximize the volume of the tub 3 and the drum 2.

The chamber drain pipe 75 may be located between the bottom surface of the tub body 31 and a lowest point of the rotor 473. A lowest point of the chamber drain pipe 75 may be lower than a lowest point of the heating chamber 71. The bottom surface 77 of the heating chamber 71 may be inclined downward toward the chamber drain pipe 75.

Accordingly, it is possible to minimize an amount of residual water in the heating chamber 71.

The chamber drain pipe 75 may be coupled to one end of the first drain pipe 61 outside a virtual cylinder that extends an outer circumferential surface of the tub body 31.

The chamber drain pipe 75 may have one end coupled to a side surface of the heating chamber 71, and the other end thereof may be a free end.

A distance from the side surface of the heating chamber 71 to the free end of the chamber drain pipe 75 may be greater than a distance from the side surface of the heating chamber 71 to the circumferential surface of the tub body 31.

The chamber drain pipe 75 may be coupled to the first drain pipe 61 at a position further outside than an outer circumferential surface of the tub body 31 with reference to the center of the tub body 31.

Accordingly, a position where the chamber drain pipe 75 and the first drain pipe 61 are coupled may be located outside the outer circumferential surface of the tub, thereby maximizing the volume of the tub 3 and the drum 2.

Referring to (b) of FIG. 10, a guide 76 may be provided at the bottom surface of the heating chamber 71. The guide 76 may be provided as a passage that protrudes from the bottom surface 77 of the heating chamber toward the bottom surface of the cabinet 1 or the bottom surface of the drawer 2 to guide water to the chamber drain pipe 75. A lowest point of the chamber drain pipe 75 may be lower than a lowest point of the guide 76.

Accordingly, it is possible to minimize an amount of water remaining in the heating chamber 71.

The chamber drain pipe 75 may be located between the bottom surface of the tub 3 and a lowest point of the rotor 473. A height of the lowest point of the chamber drain pipe 75 may be equal to a height of the lowest point of the rotor 473, or may be higher than the height of the lowest point of the rotor 473.

Accordingly, it is possible to prevent damage to the chamber drain pipe 75 at the event of vibration of the tub body 31.

Although a case where the heating part 7 and the balancer 8 are applied to the clothing treatment apparatus 100 in which the tub is provided in the drawer 2 withdrawable out from the cabinet 1 has been described, the heating part 7 and the balancer 8 may be applied to apparatuses other than the drawer-type clothing treatment apparatus.

That is, the heating part 7 and the balancer 8 may be applied to a top loading type clothing treatment apparatus that includes a cabinet, a tub fixed through a tub support part inside the cabinet, and a drum rotatably provided in the tub.

In addition, the heating part 7 and the balancer 8 may be applied to a clothing treatment apparatus fixed to an upper surface of a washing machine or an upper surface of a dryer. In this case, the drawer 2 provided in the clothing treatment apparatus 100 may be omitted. That is, the cabinet 1 of the clothing treatment apparatus may be fixed to an upper surface of a cabinet (second cabinet) of the washing machine or dryer, the tub 3 may be connected to the inside of the cabinet 1 through the tub support part 37, and a through hole may be provided in the upper surface of the cabinet 1 to expose the door 39 to the outside of the cabinet 1.

Referring to FIGS. 1 to 10, a clothing treatment apparatus according to an aspect of the present disclosure includes a tub; a drum extending in a cylindrical shape, capable of being opened upward, and rotatably disposed in the tub, and fixed to an upper portion of the drum; a balancer extending along a circumference of the drum and providing a channel communicating with an inner space of the drum; and a chamber formed inside the balancer and extending along the balancer. The chamber may include a first chamber forming a lower portion of the chamber and a second chamber forming an upper portion of the chamber. A width of the first chamber may be greater than a width of the second chamber.

According to another aspect of the present disclosure, the balancer may extend upwardly past an upper end of the drum.

According to another aspect of the present disclosure, the drum may further include a rim protruding from an upper end of a circumferential surface of the drum toward a center of rotation of the drum and providing an opening of the drum, and a support part protruding from an inner circumferential surface of the drum and extending along a circumference of the drum. The balancer may further include a fixing part protruding from an outer surface facing the inner circumferential surface of the drum and inserted between the rim and the support part of the drum.

According to another aspect of the present disclosure, the balancer may further include a fastening groove recessed from a lower end of the fixing part into which the support part of the drum is to be inserted.

According to another aspect of the present disclosure, the chamber may have a bottom surface positioned below an upper end of the fastening groove.

According to another aspect of the present disclosure, the balancer may include: a first housing defining a lower exterior of the balancer and providing the first chamber; and a second housing forming an upper exterior of the balancer, providing the second chamber, and fixed to an upper portion of the first housing.

According to another aspect of the present disclosure, a thickness of the second housing in a radial direction of the drum may be greater than a thickness of the first housing.

According to another aspect of the present disclosure, the balancer may further include a fixing part protruding from an outer surface of the first housing facing an inner circumferential surface of the drum and fixed to the inner circumferential surface of the drum. An outer surface of the second housing facing the circumferential surface of the tub may be positioned on an outer side than an outer surface of the first housing.

According to another aspect of the present disclosure, the tub may include: a tub body extending in a cylindrical shape having a diameter greater than a length and able to be opened upward; a cover forming an upper surface of the tub; and an extension extending downward from an edge of the cover and coupled to an upper portion of the tub body.

The clothing treatment apparatus according to another aspect of the present disclosure may further include a cabinet having an outlet at the front, and a drawer provided to be withdrawable from the cabinet through the outlet and providing a space for accommodating the tub.

Certain embodiments or other embodiments of the disclosure described above are not mutually exclusive or distinct from each other. Any or all elements of the embodiments of the disclosure described above may be combined with another or combined with each other in configuration or function).

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothing treatment apparatus comprising:

a tub;

a cylindrical drum rotatably provided in the tub;

a balancer fixed to an upper portion of the drum, the balancer extending along a circumference of the drum; and a chamber inside the balancer, the chamber extending along the balancer, the chamber including:

a first chamber defining a lower portion of the chamber, the first chamber having an inner circumferential surface and an outer circumferential surface; and a second chamber defining an upper portion of the chamber, the second chamber having an inner circumferential surface and an outer circumferential surface, wherein a width of the first chamber in a radial direction is greater than a width of the second chamber in the radial direction, wherein the inner circumferential surface of the second chamber and the inner circumferential surface of the first chamber are connected so as not to form a step, and wherein the outer circumferential surface of the second chamber and the outer circumferential surface of the first chamber are connected so as to form a step, wherein the balancer further includes:

a first housing defining a lower portion of the balancer, the first housing having the first chamber; and a second housing defining an upper portion of the balancer, the second housing having the second chamber, the second housing being fixed to an upper portion of the first housing.

2. The clothing treatment apparatus of claim 1, wherein the balancer extends upward past an upper end of the drum.

3. The clothing treatment apparatus of claim 1, wherein the drum further includes:

a rim protruding from an upper end of an inner circumferential surface of the drum toward a center of rotation of the drum; and a balancer support part protruding from the inner circumferential surface of the drum, the balancer support part extending along the circumference of the drum, and wherein the balancer further includes a fixing body protruding from an outer surface of the balancer, the fixing body facing the inner circumferential surface of the drum and being located between the rim and the balancer support part of the drum.

4. The clothing treatment apparatus of claim 3, wherein the balancer further includes a fastening groove at a lower end of the fixing body, and wherein the balancer support part of the drum is inserted into the fastening groove.

5. The clothing treatment apparatus of claim 4, wherein the chamber has a bottom surface positioned below an upper end of the fastening groove.

6. The clothing treatment apparatus of claim 1, wherein a thickness of a wall defining the second housing in a radial direction of the drum is greater than a thickness of a wall defining the first housing in the radial direction of the drum.

7. The clothing treatment apparatus of claim 6, wherein the balancer further includes a fixing body protruding from an outer surface of the first housing, the fixing body facing an inner circumferential surface of the drum and being fixed to the inner circumferential surface of the drum, and wherein an outer surface of the second housing is positioned outward of the outer surface of the first housing.

8. The clothing treatment apparatus of claim 1, wherein the tub includes:

a cylindrical tub body having a diameter greater than a height thereof;

a cover defining an upper surface of the tub; and an extension extending downward from an edge of the cover, the extension being coupled to an upper portion of the tub body.

9. The clothing treatment apparatus of claim 1, further comprising:

a cabinet having an opening at a front thereof; and a drawer located in the cabinet, the drawer being configured to be withdrawn from the cabinet through the opening, the drawer having a space to receive the tub therein.

* * * * *